US009274484B2

(12) United States Patent
Nakajima

(10) Patent No.: US 9,274,484 B2
(45) Date of Patent: Mar. 1, 2016

(54) IMAGE FORMING APPARATUS AND TONER ACCOMMODATION CONTAINER

(71) Applicant: CANON KABUSHIKI KAISHA, Tokyo (JP)

(72) Inventor: Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/314,246

(22) Filed: Jun. 25, 2014

(65) Prior Publication Data

US 2015/0010313 A1 Jan. 8, 2015

(30) Foreign Application Priority Data

Jul. 4, 2013 (JP) ..... 2013-140344

(51) Int. Cl.
*G03G 15/08* (2006.01)
*G03G 15/00* (2006.01)

(52) U.S. Cl.
CPC ..... *G03G 15/556* (2013.01); *G03G 15/0877* (2013.01); *G03G 15/086* (2013.01); *G03G 15/502* (2013.01); *G03G 2215/0132* (2013.01)

(58) Field of Classification Search
CPC ..... G03G 15/0831; G03G 15/0832; G03G 15/0834; G03G 15/0836; G03G 15/086; G03G 15/0862; G03G 15/087; G03G 21/1676; G03G 21/1892
See application file for complete search history.

(56) References Cited

U.S. PATENT DOCUMENTS 6,324,352 B1 * 11/2001 Suzuki ..... G03G 21/1807 399/112
8,565,649 B2 10/2013 Murakami et al.
2001/0051051 A1 * 12/2001 Matsumoto ..... G03G 21/1814 399/13
2004/0223772 A1 * 11/2004 Nakazato ..... G03G 15/0822 399/13
2006/0165441 A1 * 7/2006 Deguchi ..... G03G 15/087 399/258
2010/0272452 A1 * 10/2010 Tsukijima ..... G03G 15/553 399/27
2012/0014713 A1 1/2012 Murakami et al.
2014/0016967 A1 1/2014 Murakami et al.

FOREIGN PATENT DOCUMENTS

AU 2010-232164 A1 11/2011
AU 2010-232164 B2 5/2014

(Continued)

OTHER PUBLICATIONS

JP_2005181475_A_T, Machine Translation, Jul. 7, 2005, Nishizawa.*

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus on which a toner accommodation container accommodating toner is insertably/removably mounted to discharge the toner from the toner accommodation container by rotating the toner accommodation container includes a phase detection sensor that detects a rotation phase of the toner accommodation container by detecting a phase detection portion provided in the toner accommodation container and detects removal/mounting of the toner accommodation container from/on the image forming apparatus through the phase detection sensor.

1 Claim, 22 Drawing Sheets

(56) References Cited

FOREIGN PATENT DOCUMENTS

| | | | | |
|---|---|---|---|---|
| CA | 2 757 329 | A1 | | 10/2010 |
| EP | 2 416 222 | A1 | | 8/2012 |
| JP | 06-067532 | A | | 3/1994 |
| JP | 2002169441 | A | * | 6/2002 |
| JP | 2005-181475 | A | | 7/2005 |
| JP | 2010-256893 | A | | 11/2010 |

* cited by examiner

ON/OFF OF PHASE DETECTION SENSOR TF

ON/OFF OF PHASE DETECTION SENSOR TS

IMAGE FORMING APPARATUS AND TONER ACCOMMODATION CONTAINER

BACKGROUND OF THE INVENTION

1. Field of the Invention

The present invention relates to an image forming apparatus using the same detection portion for rotation detection and replacement detection of a toner accommodation container. The present invention also relates to an image forming apparatus on which a toner accommodation container is insertably/removably mounted and a toner accommodation container used for the mounting.

2. Description of the Related Art

As shown in U.S. Patent Application Publication No. 2012/0014713 A1 (Patent Document 1), a configuration in which a insertable/removable toner accommodation container is mounted on an image forming apparatus and a pump portion is reciprocated accompanying a rotating operation of the mounted toner accommodation container to discharge toner from a discharge port has been disclosed.

However, because there is no unit to directly detect replacement completion of replacement work of the toner accommodation container after the toner accommodation container becomes empty, it has been necessary for the user to check whether the replacement of the toner accommodation container is complete (for the user to input replacement completion of the toner accommodation container).

After the checking, the replacement of the toner accommodation container is grasped only after an increase of the amount of toner in a developing apparatus being detected by causing the rotating operation of the toner accommodation container.

It is desirable to provide an image forming apparatus in an inexpensive configuration that makes it unnecessary to cause the user to perform a troublesome operation to check whether replacement is completed by performing replacement detection and rotation detection of a toner accommodation container.

SUMMARY OF THE INVENTION

An embodiment of the present invention is an image forming apparatus including a mounted portion on which a toner accommodation container discharging toner by rotating is mounted, and a phase detection sensor that detects a rotation phase of the toner accommodation container. The phase detection sensor detects the rotation phase of the toner accommodation container by detecting that a detected portion provided in the toner accommodation container to detect a phase is positioned in a detection position, an output portion that outputs information prompting for replacement of the toner accommodation container, and a controller that controls the toner accommodation container to rotate and stop based on a signal from the phase detection sensor in order to stop the toner accommodation container in such a way that the detected portion is in the detection position. The controller performs a predetermined operation concerning replacement of the toner accommodation container based on the signal from the phase detection sensor after the information being output by the output portion.

Further features of the present invention will become apparent from the following description of exemplary embodiments with reference to the attached drawings.

DESCRIPTION OF THE EMBODIMENTS

Exemplary embodiments of the present invention will illustratively be described in detail below with reference to the drawings. However, dimensions, materials, shapes, and relative arrangements of components described in the following embodiments should appropriately be changed depending on the configuration of the apparatus to which the present invention is applied and various conditions. Therefore, if not specifically mentioned, the scope of the present invention should not be limited to such dimensions, materials, shapes, and relative arrangements.

First Embodiment

Image Forming Apparatus

Figure 1:
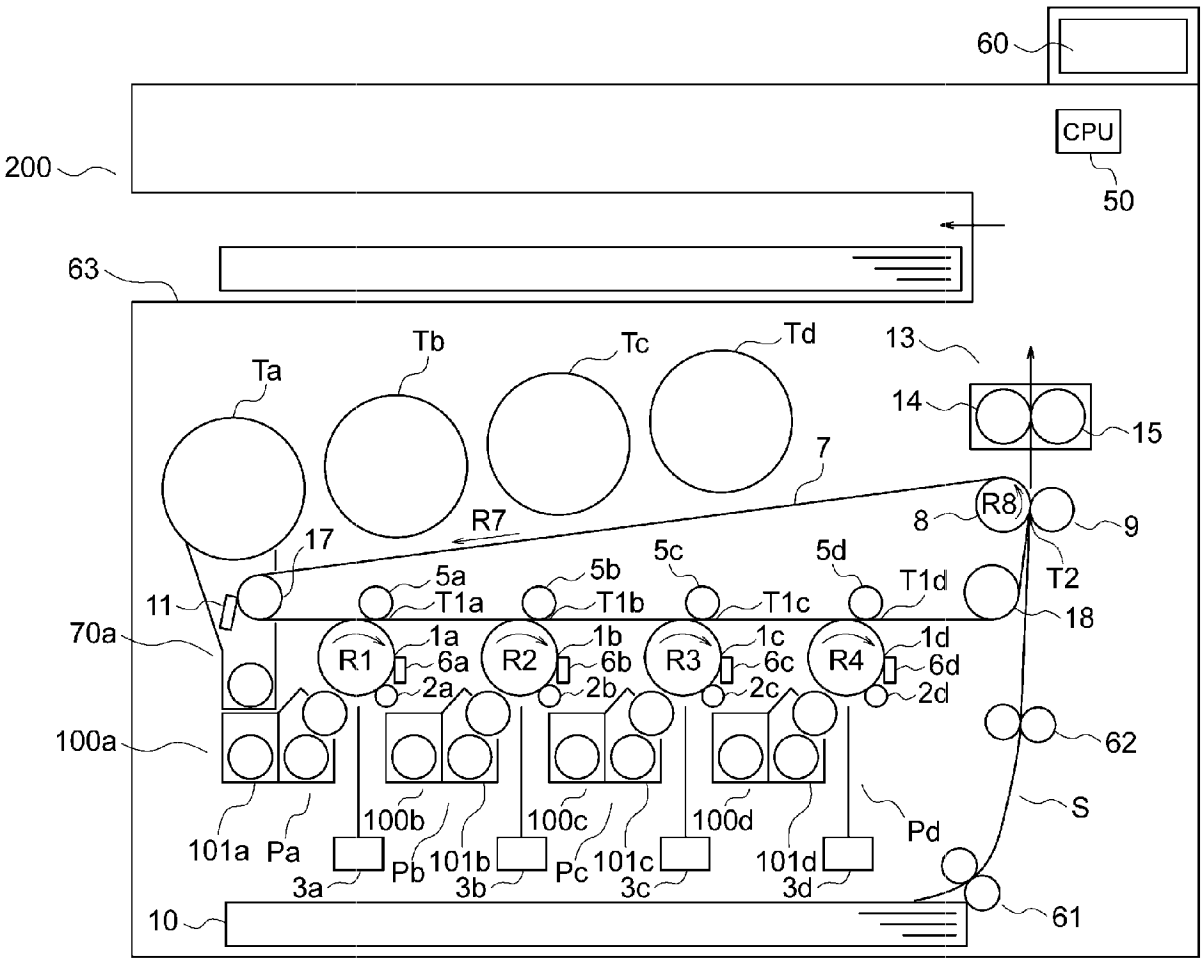
FIG. 1 is a sectional view illustrating an operation of an image forming apparatus.

An image forming apparatus according to the present invention will be described. FIG. 1 is a sectional view of a color image forming apparatus using an electrophotographic system and an image forming apparatus 200 is a so-called intermediate transfer tandem image forming apparatus in which four image forming portions are arranged side by side on an intermediate transfer belt 7. The intermediate transfer tandem system is a mainstream configuration in recent years in view of high productivity and the fact that various media can be supported. In FIG. 1, the width direction perpendicular to the transportation direction of a recording material is a forward-backward direction of the apparatus.

<Transportation process of a recording material>

A recording material S is accommodated by being stacked in a recording material repository 10 and is fed by a feeding roller 61 adopting a friction separation method by adjusting to image forming timing. The recording material S fed by the feeding roller 61 passes through a transportation path before being transported to a registration roller 62. After skew feeding corrections or timing corrections being made by the registration roller 62, the recording material S is sent to a secondary transfer portion T2. The secondary transfer portion T2 is a transfer nip portion formed of a secondary transfer internal roller 8 and a secondary transfer external roller 9 opposite to each other and causes the recording material S to absorb a toner image thereinto by providing a predetermined applied pressure and an electrostatic load bias.

<Image creating process>

A forming process of an image sent to the secondary transfer portion T2 in similar timing corresponding to the transportation process of the recording material S up to the secondary transfer portion T2 described above will be described.

Image forming portions Pa to Pd mainly includes photosensitive bodies 1*a* to 1*d*, charging apparatuses 2*a* to 2*d*, exposure devices 3*a* to 3*d*, developing apparatuses 100*a* to 100*d*, developing containers 101*a* to 101*d*, primary transfer units T1*a* to T1*d*, and photosensitive body cleaners 6*a* to 6*d* respectively.

The exposure devices 3*a* to 3*d* are driven based on a signal of sent image information with respect to the photosensitive bodies 1*a* to 1*d* whose surface is uniformly charged by the charging apparatuses 2*a* to 2*d* in advance and driven to rotate by a development driving apparatus (not illustrated) to form electrostatic latent images via a diffraction unit when appropriate. Next, the electrostatic latent images formed on the photosensitive bodies 1*a* to 1*d* manifest themselves as toner images by undergoing toner development by the developing apparatuses 100*a* to 100*d*. Then, a predetermined applied pressure and an electrostatic load bias are provided by the primary transfer units T1*a* to T1*d* and the toner images are transferred onto the intermediate transfer belt 7. Lastly, remaining transfer toner slightly remaining on the photosensitive bodies 1*a* to 1*d* is collected by the photosensitive body cleaners 6*a* to 6*d* in preparation for the next image creating process.

An induction sensor IS that outputs the ratio of the toner and magnetic carriers as a voltage in accordance with permeability is provided in each of the developing apparatuses 100*a* to 100*d* and when the amount of toner decreases in accordance with the value of the induction sensor IS, the toner is supplied from corresponding toner accommodation containers Ta to Td (Tb to Td have the same shape as Ta). At this point, toner supply apparatuses 70*a* to 70*d* (70*b* to 70*d* have the same shape as 70*a* and thus, only 70*a* is illustrated in FIGS. 1 and 70*a* to 70*d* are abbreviated as 70 below) supply toner by being driven in synchronization with the corresponding developing apparatuses 100*a* to 100*d*. A supply operation will be described later.

Figure 4:
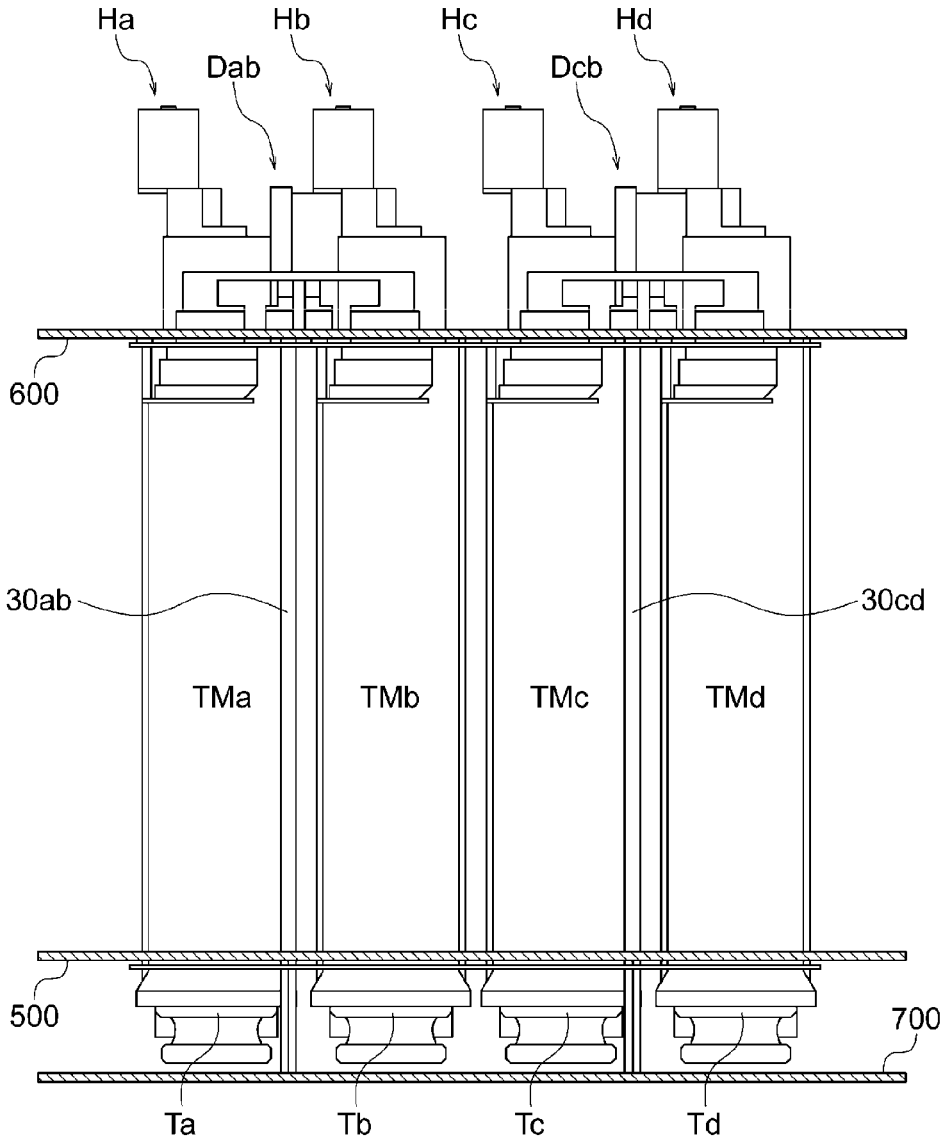
FIG. 4 is a top view of the image forming apparatus.

The toner accommodation containers Ta to Td are insertably/removably mounted on an image forming apparatus. The insertion/removal direction of the toner accommodation containers Ta to Td into/from the image forming apparatus is a direction intersecting the rotation direction of the toner accommodation containers Ta to Td installed in the image forming apparatus. As illustrated in FIG. 4, the toner accommodation containers Ta to Td are accommodated and held by toner accommodation container holding members TMa to TMd suspended between a front plate 500 and a rear plate 600 respectively. The toner accommodation container holding members TMa to TMd are independently suspended between the front plate 500 and the rear plate 600. The development driving apparatus is fastened and installed on the rear plate 600.

In the case of FIG. 1, four sets of yellow (Y), magenta (M), cyan (C), and black (Bk) are present for the image forming portions Pa to Pd. However, the number of colors is not limited to four and the order of arrangement of colors is not limited to the above example. A two-component developer in which toner and magnetic carriers are mixed is accommodated inside the developing containers 101*a* to 101*d* in advance, but a monocomponent developer of magnetic toner or non-magnetic toner may be accommodated. In the present embodiment, a case when a two-component developer (initial agent) is accommodated is described.

Next, the intermediate transfer belt 7 will be described. The intermediate transfer belt 7 is installed on an intermediate transfer belt frame (not illustrated). The intermediate transfer belt 7 is an endless belt, is stretched by the secondary transfer internal roller 8, a tension roller 17, and a secondary transfer upstream roller 18 serving also as drive transmission units to the intermediate transfer belt, and is driven to be transported in an arrow R7 direction in FIG. 1. The image creating process of each color performed in parallel by the image forming portions Pa to Pd of the Y, M, C, and Bk is performed in timing in which the color is stacked onto the toner image of upstream colors primarily transferred onto the intermediate transfer belt 7. As a result, a full-color toner image is formed on the intermediate transfer belt 7 in the end and transported to the secondary transfer portion T2. Remaining transfer toner after passing through the secondary transfer portion T2 is collected by a transfer cleaner apparatus 11.

<Process after the secondary transfer>

With the transportation process and the image creating process described above, the timing of the recording material S and that of the full-color toner image match in the secondary transfer portion and then a secondary transfer is performed. Thereafter, the recording material S is transported to a fixing device 13. The fixing device 13 is used to fuse and fix the toner image onto the passing recording material S by providing predetermined pressure and heat in a fixing nip formed of opposed rollers. Therefore, the fixing device 13 includes a heater as a heat source and is controlled such that the optimum temperature is always maintained. The route of the recording material S onto which an image is fixed as described above is selected and is discharged onto a discharge tray 63 or if an image is to be formed on both sides, is transported to a reversal/transport apparatus (not illustrated).

<Toner accommodation container>

Next, the toner accommodation containers Ta to Td (each container has the common shape and thus, Ta to Td are denoted as T below) held by the toner accommodation container holding members TMa to TMd (each holding member has the common shape and thus, TMa to TMd are denoted as TM below) will be described by using FIGS. 2A and 2B.

Figure 2A:
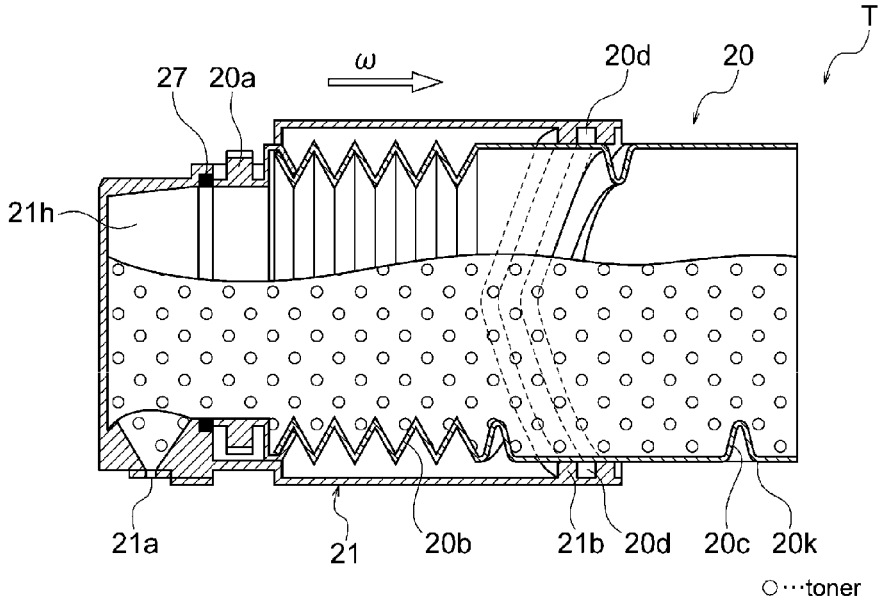
FIGS. 2A and 2B are sectional views of a toner accommodation container.

As illustrated in FIG. 2A, the toner accommodation container T has a toner accommodation portion 20 formed in a hollow cylindrical shape and including an internal space to internally accommodate toner. Further, the toner accommodation container T has a flange portion 21 (also called a non-rotating portion) on one side in the longitudinal direction (developer transportation direction) of the toner accommodation portion 20. The toner accommodation portion 20 is configured to be relatively rotatable with respect to the flange portion 21.

Figure 2B:
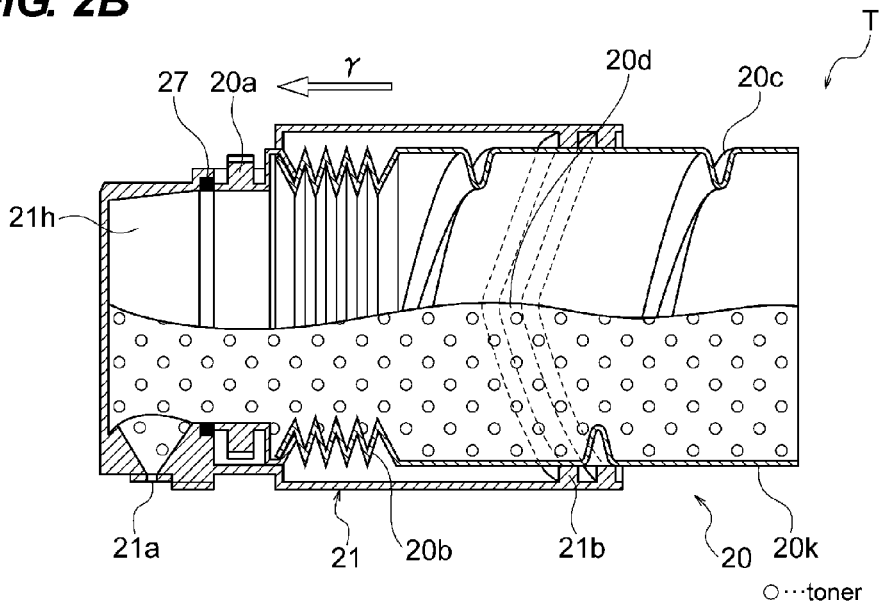

As illustrated in FIG. 2B, the flange portion 21 is provided with a hollow discharge portion 21*h* to temporarily store toner transported from inside the toner accommodation portion 20. At the bottom of the discharge portion 21*h*, a small discharge port 21*a* allowing toner to be discharged out of the toner accommodation container T, that is, to supply toner to the toner supply apparatus 70. The flange portion 21 is provided so as to be unable to rotate when the toner accommodation container is mounted on (installed in) the image forming apparatus. The flange portion 21 is provided with a plane (bottom) 21*e* guided in the rotational axis direction of the container while being in surface contact with a toner accommodation container holding member TM when the toner accommodation container T is inserted/removed into/from the image forming apparatus (see FIG. 10). With the bottom 21*e* of the flange portion 21 being in surface contact with the toner accommodation container holding member TM, the flange portion 21 of the toner accommodation container T is inserted/mounted in a state not rotating with respect to the apparatus body.

A pump portion 20*b* in the present example functions as an intake and exhaust mechanism that alternately causes an intake operation and an exhaust operation via the discharge port 21*a*.

As illustrated in FIG. 2B, the pump portion 20*b* is provided between the discharge portion 21*h* and a cylindrical portion 20*k* and connected and fixed to the cylindrical portion 20*k*. That is, the pump portion 20*b* is rotatable integrally with the cylindrical portion 20*k*. In addition, the pump portion 20*b* in the present example is configured to be able to accommodate toner therein.

In the present example, a volume variable pump (bellows pump) made of resin whose volume can change accompanying a reciprocating operation is adopted as the pump portion 20*b*. More specifically, as illustrated in FIGS. 2A and 2B, a bellows pump is adopted and a plurality of "mountain folding" portions and "valley folding" portions is formed periodically and alternately.

Also, as illustrated in FIG. 2B, the pump portion 20*b* is fixed relatively rotatably with respect to the discharge portion 21*h* while a ring seal member 27 provided on an inner surface of the flange portion 21 being compressed by an edge on the discharge portion 21*h* side.

The toner accommodation container T is provided with a gear portion 20*a*. The gear portion 20*a* is fixed to one side in the longitudinal direction of the pump portion 20*b*. That is, the gear portion 20*a*, the pump portion 20*b*, and the cylindrical portion 20*k* are configured to be integrally rotatable.

Therefore, a rotational driving force input into the gear portion 20*a* is designed to be transmitted to the cylindrical portion 20*k* (transportation portion 20*c*) via the pump portion 20*b*.

Figure 3:
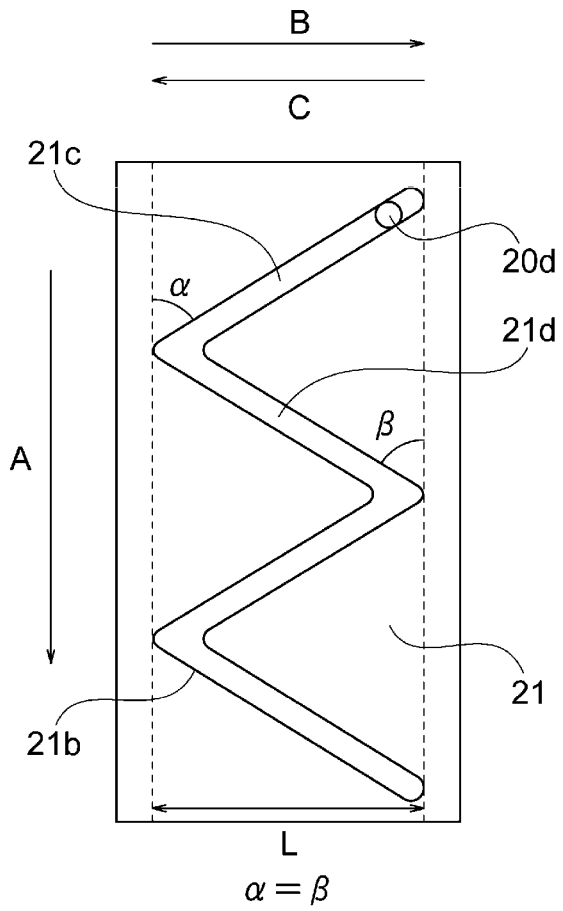
FIG. 3 is a partially enlarged view of the toner accommodation container.

On the other hand, a cam groove 21*b* functioning as a driven portion into which a cam projection 20*d* is fitted is formed all around the inner surface of the flange portion 21. The cam groove 21*b* will be described by using FIG. 3. In FIG. 3, an arrow A shows the rotation direction of the cylindrical portion 20*k* (direction of movement of the cam projection 20*d*), an arrow B shows the expansion direction of the pump portion 20*b*, and an arrow C shows the contraction direction of the pump portion 20*b*. It is assumed that the angle of a cam groove 21*c* formed with the rotation direction A of the cylindrical portion 20*k* is $\alpha$ and the angle of a cam groove 21*d* is $\beta$. It is also assumed that the amplitude of the cam groove 21*b* (=expansion and contraction length of the pump portion 20*b*) in the expansion and contraction directions B, C of the pump portion 20*b* is L.

More specifically, as illustrated in FIG. 3 in which the cam groove 21*b* is expanded, the cam groove 21*b* has a structure in which the cam groove 21*c* as a groove portion inclined from the cylindrical portion 20*k* side to the discharge portion 21*h* side and the cam groove 21*d* as a groove portion inclined from the discharge portion 21*h* side to the cylindrical portion 20*k* side are alternately linked. In the present example, $\alpha=\beta$ is set.

Therefore, in the present example, the cam projection 20*d* and the cam groove 21*b* function as a drive transmission mechanism to the pump portion 20*b*. That is, the cam projection 20*d* and the cam groove 21*b* function as a mechanism that converts a rotational driving force received by the gear portion 20*a* into a force in a direction causing the pump portion 20*b* to reciprocate (force in the rotational axis direction of the cylindrical portion 20*k*) and transmits the force to the pump portion 20*b*.

<Supply configuration>

Next, the supply mechanism to discharge toner from the toner accommodation container T will be described by using FIGS. 4 to 7.

Figure 5:
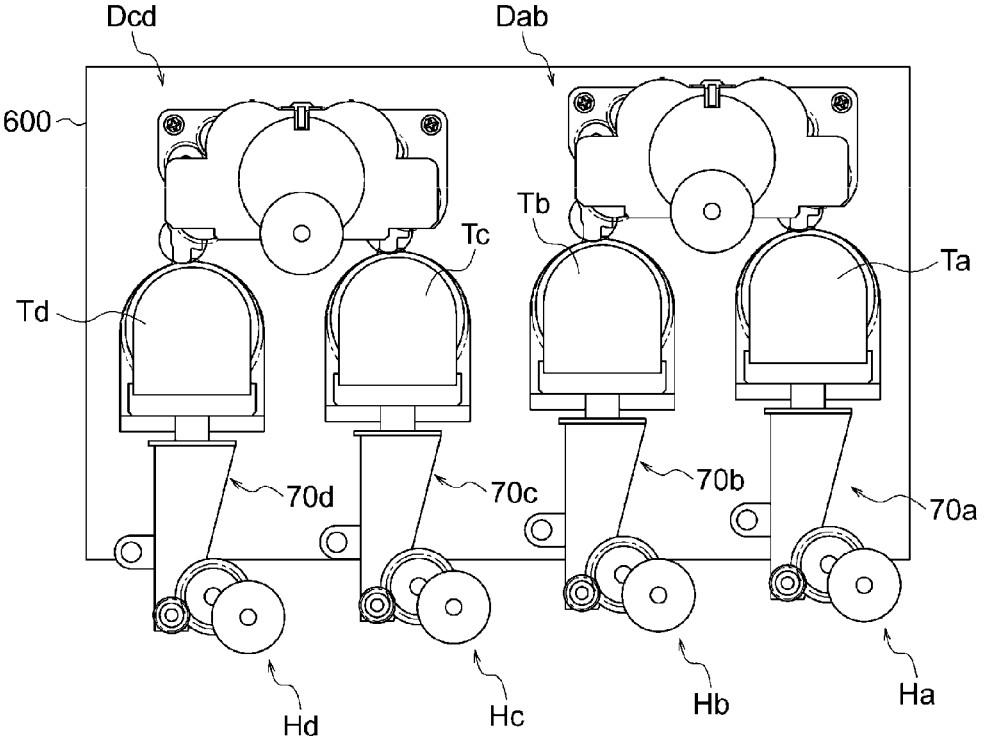
FIG. 5 is a rear view of the image forming apparatus.
Figure 6:
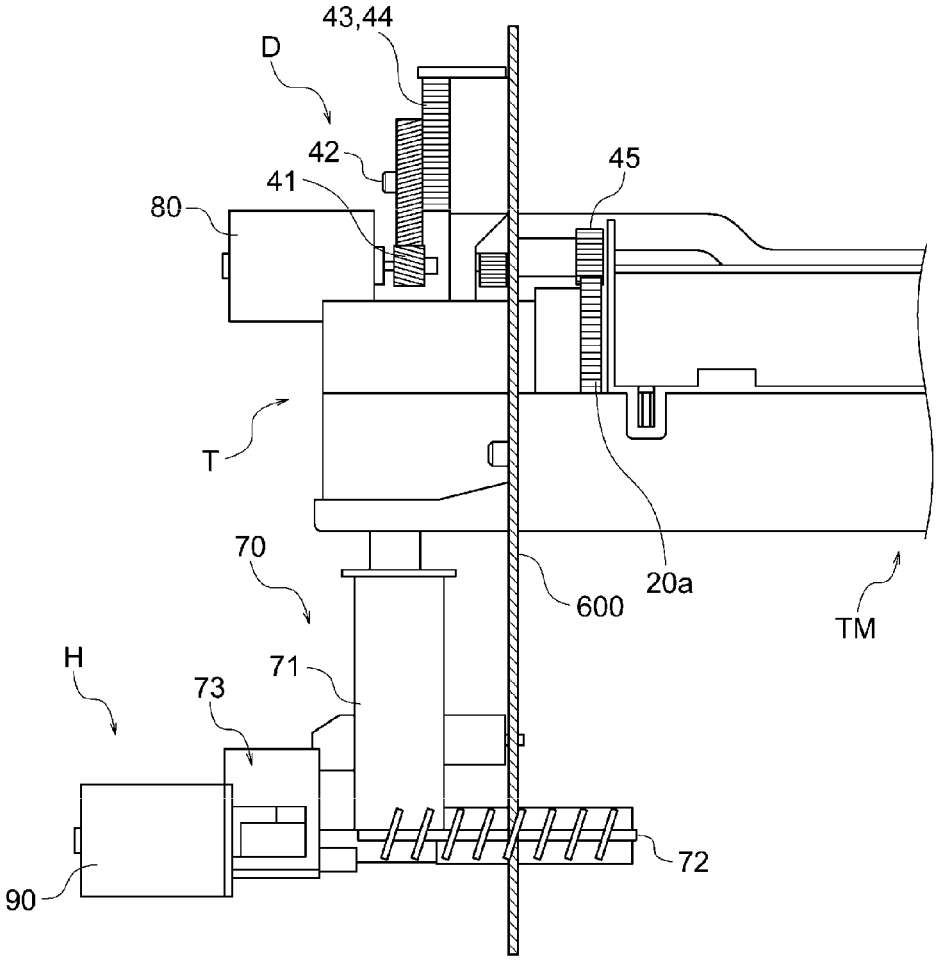
FIG. 6 is a left side view of a supply apparatus.
Figure 7:
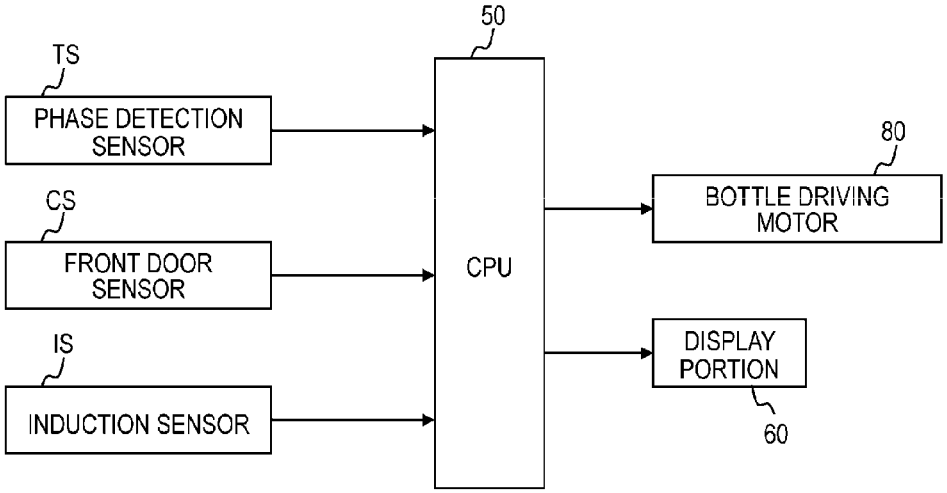
FIG. 7 is a control block diagram.

FIG. 4 is a top view of an apparatus body, FIG. 5 is a rear view of the apparatus body, FIG. 6 is a left side view of a supply apparatus, and FIG. 7 is a supply control block diagram.

The toner accommodation container T is freely detachably accommodated in the toner accommodation container holding member TM stretched by the front plate 500 and the rear plate 600. In addition, a front door 700 openably/closably provided in the apparatus body of the image forming apparatus covers an insertion/removal side of the toner accommodation container.

Supply driving apparatuses Dab, Dcd (Dab and Dcd have the same shape and thus, Dab and Dcd are abbreviated as D below) are installed on the rear plate 600. A supply driving apparatus D includes a bottle driving motor 80 and a gear row (details thereof will be described later) for drive reduction transmission and a driving gear 45 is installed in the last step of the gear row. The driving gear 45 is linked to drive the gear portion 20*a* on the toner accommodation container T.

From the above, the drive from the bottle driving motor 80 is transmitted to the toner accommodation container T so that a toner supply operation of the toner accommodation container T can be performed.

The time of rotation and the turnover number of the bottle driving motor 80 are decided by a CPU 50 illustrated in FIG. 7. In this case, the CPU 50 as a control unit decides the rotation stop position based on the value of a phase detection sensor TS as a phase detection unit such that the pump portion 20*b* of the toner accommodation container T can start each supply from a contracted state (FIG. 2B) (details thereof will be described later). The time of rotation and the turnover number of the bottle driving motor 80 are determined by the CPU 50 illustrated in FIG. 7 depending on whether the value output from the induction sensor IS is above or below a predetermined threshold.

Figure 8:
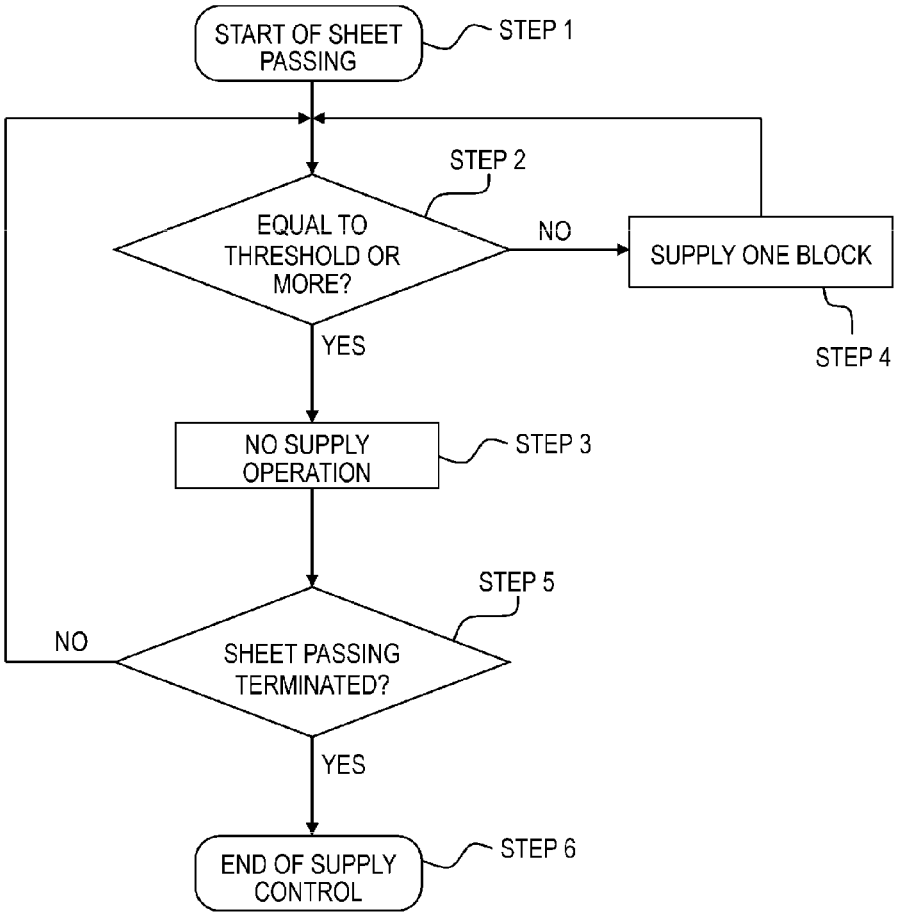
FIG. 8 is a flow chart illustrating a control flow of a toner supply operation.

A control flow is illustrated in FIG. 8. The CPU 50 receives an output value from the induction sensor IS accompanying a sheet passing operation of the recording material S (STEP 2), does not perform a supply operation if the output value is equal to the threshold or more (STEP 3), and supplies sheets for one block if the output value is less than the threshold (STEP 4). Here, one block refers to a time span of the phase detection sensor TS from ON to OFF back to ON. Details thereof will be described later.

If the sheet passing ends (STEP 5), the supply control also ends (STEP 6) and if a subsequent sheet is passed, the control flow returns to STEP 2.

Figure 17A:
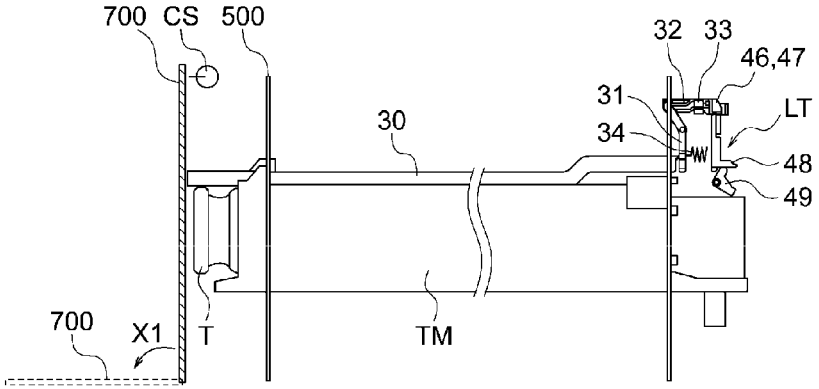
FIGS. 17A to 17C are right side views of the image formation apparatus in the second embodiment.
Figure 17B:
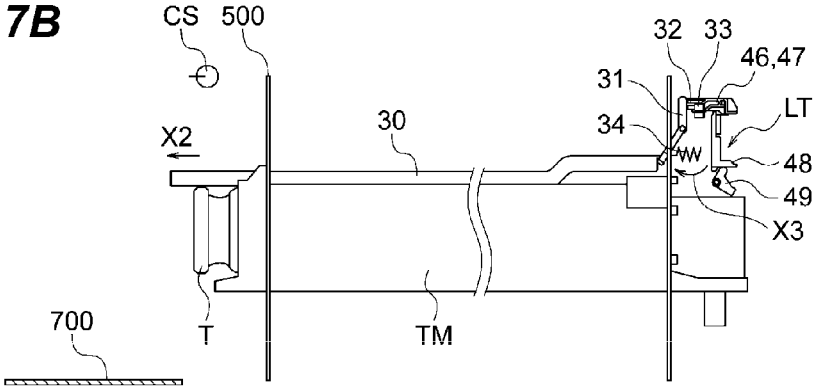
Figure 17C:
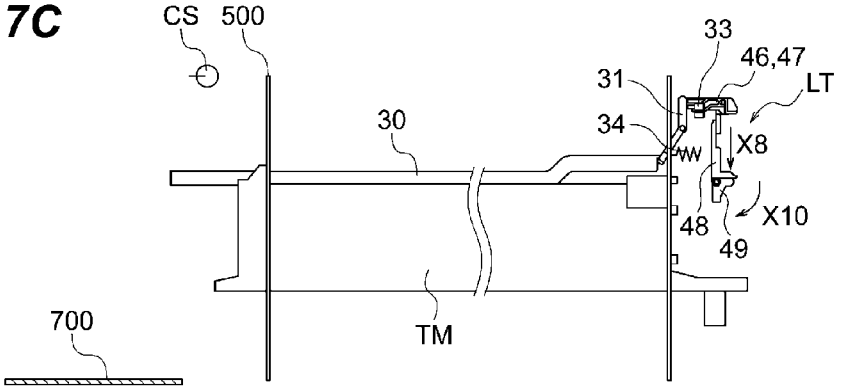

The bottle driving motor 80 becomes operable only in a state in which the front door 700 illustrated in FIGS. 17A to 17C covers the insertion/removal direction of the toner accommodation container T (a front door sensor CS is ON). The open/closed state of the front door 700 is displayed in a display portion 60 as an output portion in accordance with the ON-OFF state of the front door sensor CS as an opening/closing detection unit that detects opening/closing of the front door 700.

Accordingly, a predetermined amount of toner is sent from the toner accommodation container T into the toner supply apparatus 70 in a stable manner.

The toner supply apparatus 70 includes an accommodation portion 71, a transportation motor 90, and a screw 72 linked to drive the gear row 73. The toner supply apparatus 70 can accommodate toner inside the accommodation portion 71. The toner supply apparatus 70 transports toner sent into the toner supply apparatus 70 to the developing apparatus 100 by, as described above, the transportation motor 90 being rotated in synchronization with the development driving apparatus to perform the image forming operation.

<Supply driving configuration>

Next, the supply driving configuration will be described by using FIG. 9.

Figure 9:
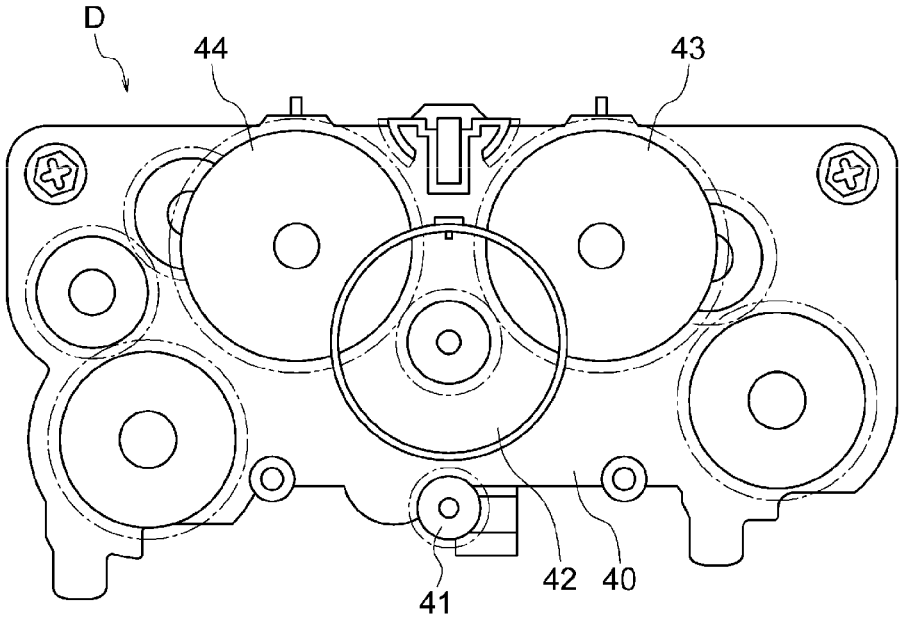
FIG. 9 is an explanatory view of a supply driving apparatus.

FIG. 9 is a diagram when the supply driving apparatus D is viewed from the rear side of the image forming apparatus. In the supply driving apparatus D, a pinion gear 41 provided coaxially with the bottle driving motor 80 is installed by being engaged with a swing gear 42 (see FIG. 6). The swing gear 42 is movably supported by a long hole 40*a* in a circular arc shape provided in a gear frame 40 around the pinion gear 41. Accordingly, the swing gear 42 swings along the long hole 40*a* while rotating when the rotation of the bottle driving motor 80 is transmitted via the pinion gear 41.

The swing gear 42 is swung in the right direction by the bottle driving motor 80 in FIG. 9 being rotated clockwise to engage with a step gear 43 rotatably supported by the gear frame 40. Conversely, the swing gear 42 is swung in the left direction by the bottle driving motor 80 being rotated counterclockwise to engage with a step gear 44 rotatably supported by the gear frame 40. The drive is not transmitted to the step gear 44 side when the swing gear 42 is engaged with the step gear 43 and the drive is not transmitted to the step gear 43 side when the swing gear 42 is engaged with the step gear 44. Downstream of the step gears 43, 44, the drive is linked to the gear portion 20*a* on the toner accommodation container T while predetermined deceleration being performed. That is, the toner accommodation containers Ta, Tc can be operated by the bottle driving motor 80 in FIG. 9 being rotated counterclockwise and the toner accommodation containers Tb, Td can be operated by the bottle driving motor 80 being rotated clockwise.

<Toner accommodation container rotation detection configuration>

Next, the toner accommodation container rotation detection configuration having a featuring configuration of the present embodiment will be described in detail by using FIGS. 10 to 12.

Figure 10:
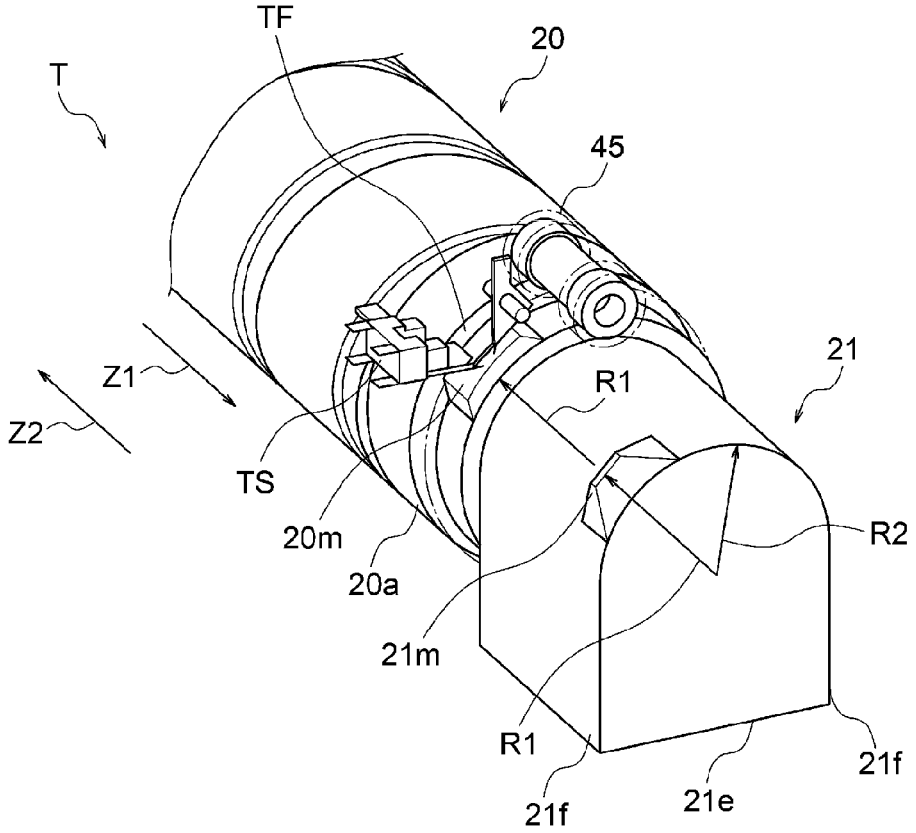
FIG. 10 is a perspective view of the toner accommodation container in a first embodiment.
Figure 11A:
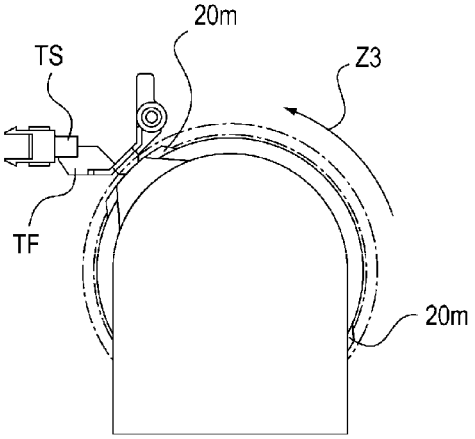
FIGS. 11A to 11D are rotation transition diagrams of the toner accommodation container in the first embodiment.

FIG. 10 is a perspective view when the toner accommodation container T is installed in the image forming apparatus body.

The toner accommodation container T is provided with a phase detection portion 20*m* rotating integrally with the gear portion 20*a*. The phase detection portion 20*m* is used to detect an expansion/contraction state of the pump portion 20*b* and the installation state in FIG. 11A is in a phase relationship corresponding to the state of the pump portion 20*b* in FIG. 2B (state in which the pump portion 20*b* is contracted).

The phase detection portion 20*m* is provided by projecting from the circumferential surface of the toner accommodation portion 20 of the toner accommodation container T. In this case, the phase detection portion 20*m* is provided in two locations on the circumferential surface of the toner accommodation portion 20 and the one phase detection portion 20*m* not illustrated in FIG. 10 is located in a position having a phase relationship of 180° with respect to the phase detection portion 20*m* illustrated in FIG. 10 and this one is also configured to be in a state in which the pump portion 20*b* is contracted.

A detection flag TF capable of contacting the phase detection portion 20*m* is rotatably supported by the image forming apparatus side. The detection flag TF is located in a position that does not block the optical axis of the phase detection sensor TS while the phase detection portion 20*m* of the toner accommodation container T is not in contact (see FIGS. 11B and 11D). Then, as illustrated in FIG. 10, the detection flag TF is displaced to a position that blocks the optical axis of the phase detection sensor TS after the phase detection portion 20*m* of the toner accommodation container T comes into contact with the detection flag TF. Accordingly, the phase detection sensor TS as an infrared photo sensor detects that the phase detection portion 20*m* is located in the predetermined position and detects the rotation phase of the toner accommodation container.

Details thereof will be described by using FIGS. 11 and 12. FIGS. 11A to 11D are diagrams when the toner accommodation container T is viewed from the rear side of the apparatus and FIG. 12 is a rotation detection sensor signal transition diagram. States of FIGS. 11A to 11D and ON-OFF signals of the phase detection sensors TS of (a) to (d) illustrated in FIG. 12 correspond respectively. In addition, the state of FIG. 10 corresponds to that of FIG. 11A.

In the initial state (FIG. 11A), the phase detection sensor TS is ON. When a drive is input into the toner accommodation container T, the toner accommodation portion 20 rotates in an arrow Z3 direction with respect to the flange portion 21 as a non-rotating portion and the phase detection portion 20*m* provided on the circumferential surface of the toner accommodation portion 20 also rotates in the arrow Z3 direction. With the phase detection portion 20*m* rotating in the arrow Z3 direction and the detection flag TF moving away from the phase detection sensors TS, the phase detection sensors TS is turned OFF (FIG. 11B).

Figure 11B:
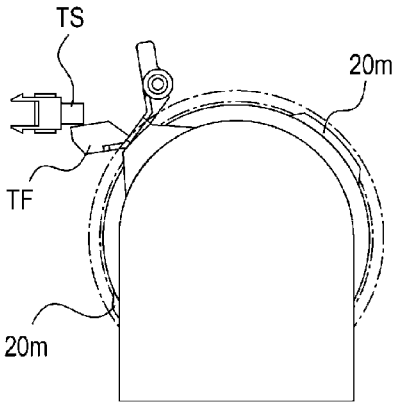
Figure 12:
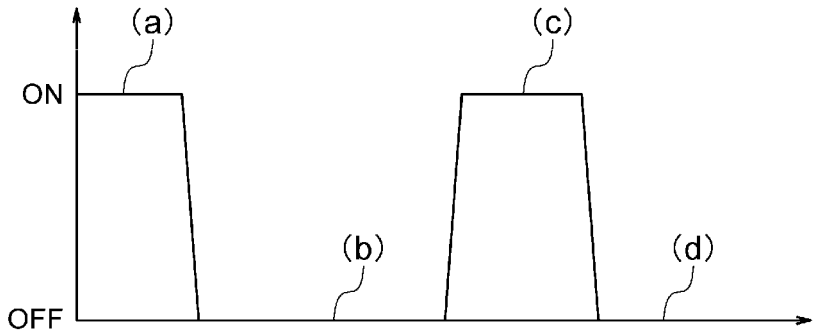
FIG. 12 is a rotation detection transition diagram in the first embodiment.

The state of FIG. 11B is in a phase relationship corresponding to the state of the pump portion 20*b* in FIG. 2A (state in which the pump portion 20*b* is expanded).

Figure 11C:
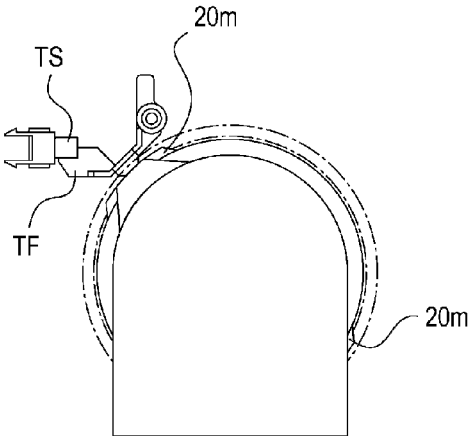
Figure 11D:
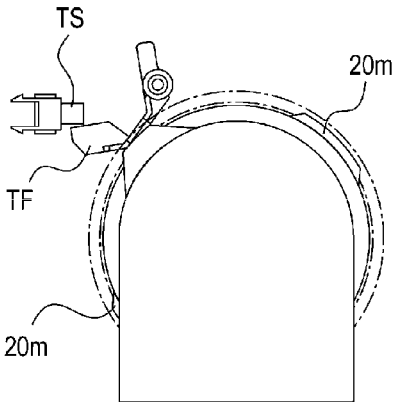

Further, if the phase detection portion 20*m* continues to rotate, the state of FIG. 11C is reached and the phase detection sensor TS is turned ON. By making a transition from the state of FIG. 11A to the state of FIG. 11C, toner is discharged from the toner accommodation container T. The process up to here is one cycle of toner discharge. If the phase detection portion 20*m* still continues to rotate, the state of FIG. 11D is reached before a transition to the state of FIG. 11A is made.

In the present configuration, the CPU 50 controls the rotation of the bottle driving motor 80 so that the phase detection portion 20*m* is in the state of FIG. 11A or the state of FIG. 11C when the toner supply is stopped. That is, the toner supply operation is started from the state of FIG. 11A or the state of FIG. 11C.

<Toner accommodation container replacement detection configuration>

Next, the toner accommodation container replacement detection configuration having a featuring configuration of the present embodiment will be described in detail by using FIGS. 10, 13, and 14. In the present embodiment, removal/mounting of the toner accommodation container T from/into the image forming apparatus is detected by the phase detection sensor TS.

As illustrated in FIG. 10, an insertion/removal detection portion 21*m* is provided in the flange portion 21 of the toner accommodation container T. The insertion/removal detection portion 21*m* is provided in the flange portion 21 so as to be flush with the phase detection portion 20*m* in the insertion/removal directions Z1, Z2 of the toner accommodation container T. The insertion/removal detection portion 21*m* has the same radius R1 as that of the phase detection portion 20*m* on the projection plane in the main body insertion/removal direction of the toner accommodation container T. That is, the insertion/removal detection portion 21*m* is configured in a position where the phase detection sensor TS is turned ON when the toner accommodation container T is moved in an arrow Z2 direction in FIG. 10 (direction in which the toner accommodation container T is removed from the main body).

The flange portion 21 has an outer circumferential radius of R2 and is configured such that R1>R2 holds and also the phase detection sensor TS is turned OFF when the detection flag TF abuts on the surface of R2.

The relationship among the phase detection portion 20*m*, the insertion/removal detection portion 21*m*, and the phase detection sensor TS will be described in detail by using FIGS. 13 and 14.

Figure 13A:
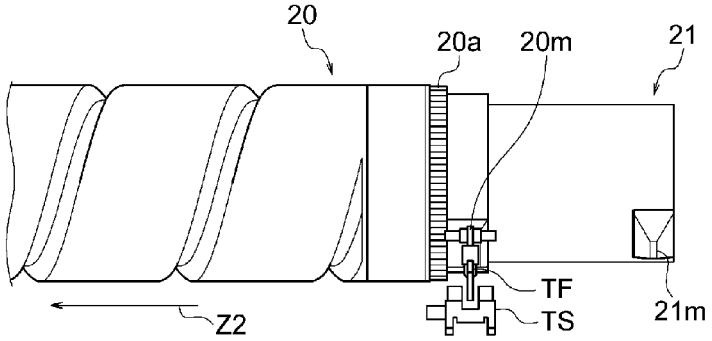
FIGS. 13A to 13D are insertion/removal transition diagrams of the toner accommodation container in the first embodiment.
Figure 13B:
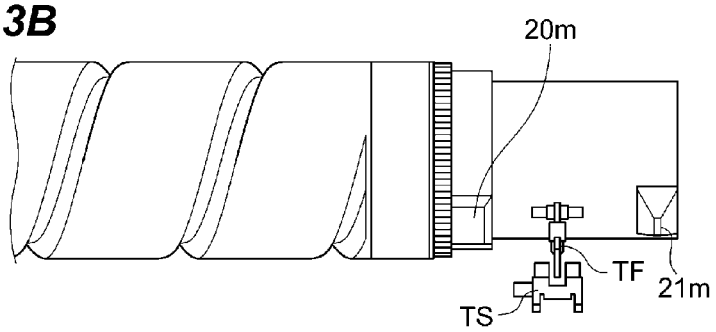
Figure 13C:
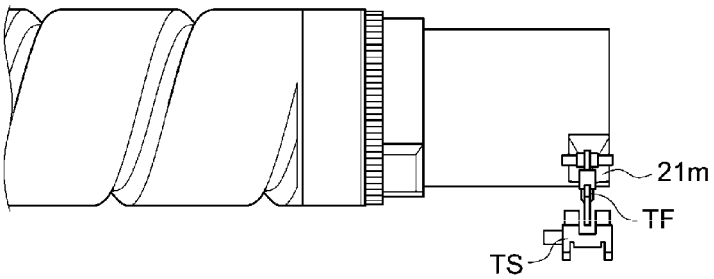
Figure 13D:
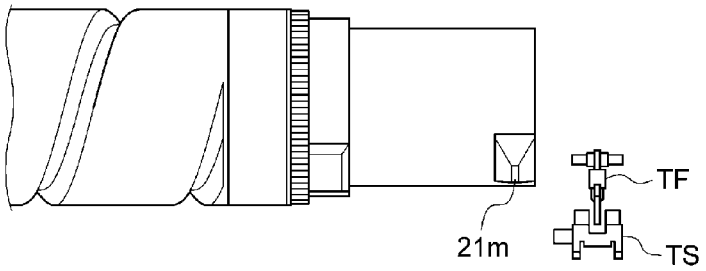
Figure 14:
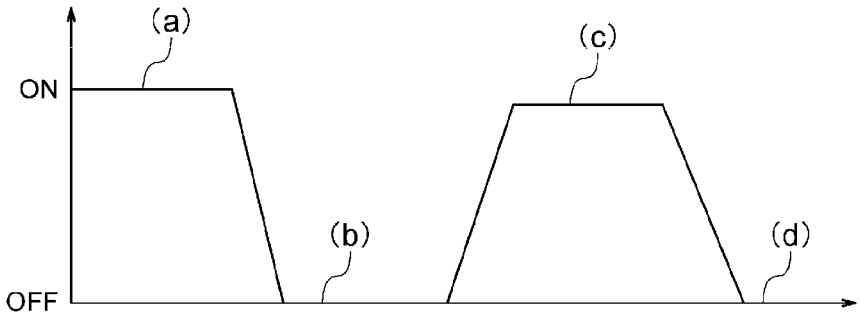
FIG. 14 is an insertion/removal detection transition diagram in the first embodiment.

FIGS. 13A to 13D are diagrams when the toner accommodation container T is viewed from above the main body and FIG. 14 is a rotation detection sensor signal transition diagram. States of FIGS. 13A to 13D and ON-OFF signals of the phase detection sensors TS of (a) to (d) illustrated in FIG. 14 correspond respectively. In addition, the state of FIG. 13A corresponds to that of FIG. 10.

In the initial state illustrated in FIG. 13A, the phase detection portion 20*m* is in contact with the detection flag TF and the detection flag TF is located in a position that blocks the optical axis of the phase detection sensor TS and therefore, the phase detection sensor TS is turned ON.

If the toner accommodation container T is moved in the arrow Z2 direction in FIG. 13A from the initial state illustrated in FIG. 13A, as illustrated in FIG. 13B, the phase detection portion 20*m* moves away from the detection flag TF and the detection flag TF is displaced to a position that does not block the optical axis of the phase detection sensor TS. Accordingly, the phase detection sensor TS is turned OFF.

If the toner accommodation container T is still moved in the arrow Z2 direction in FIG. 13A, as illustrated in FIG. 13C, the insertion/removal detection portion 21*m* comes in contact with the detection flag TF and the detection flag TF is displaced to a position that blocks the optical axis of the phase detection sensor TS. Accordingly, the phase detection sensor TS is turned ON again.

Then, if the toner accommodation container T is still moved in the arrow Z2 direction in FIG. 13A, as illustrated in FIG. 13D, the insertion/removal detection portion 21*m* moves away from the detection flag TF and the detection flag TF is displaced to a position that does not block the optical axis of the phase detection sensor TS. Accordingly, the phase detection sensor TS is turned OFF again. In this manner, the toner accommodation container T is removed from the apparatus body.

If the front door 700 is in an open state (the front door sensor CS is OFF) and the phase detection sensor TS changes like ON-OFF-ON-OFF, the removal of the toner accommodation container T from the apparatus body can be determined.

When the toner accommodation container T is inserted into the apparatus body, the bottom 21*e* (see FIG. 10) of the flange portion 21 as a non-rotating portion of the toner accommodation container T is guided in the insertion direction (rotational axis direction of the container) while being in surface contact with the toner accommodation container holding member TM. Accordingly, the flange portion 21 of the toner accommodation container T is guided while being regulated in rotation by the toner accommodation container holding member TM. Thus, the toner accommodation container T is inserted while the flange portion 21 is not rotating with respect to the apparatus body and the insertion/removal detection portion 21*m* provided in the flange portion 21 (non-rotating portion) always turns ON the phase detection sensor TS. Therefore, if the phase detection sensor TS is turned ON in this manner, the insertion of the toner accommodation container T into the apparatus body can be determined.

Here, the configuration in which the bottom (plane) 21*e* of the flange portion 21 is in surface contact with the toner accommodation container holding member TM is exemplified as a configuration to regulate the rotation of the flange portion 21 of the toner accommodation container T, but the configuration is not limited to such an example. For example, a configuration in which the toner accommodation container holding member TM is provided with a regulation portion that regulates the rotation of the flange portion 21 by abutting on a side 21*f* (see FIG. 10) of the flange portion 21 may be adopted.

<Replacement detection flow>

Figure 15:
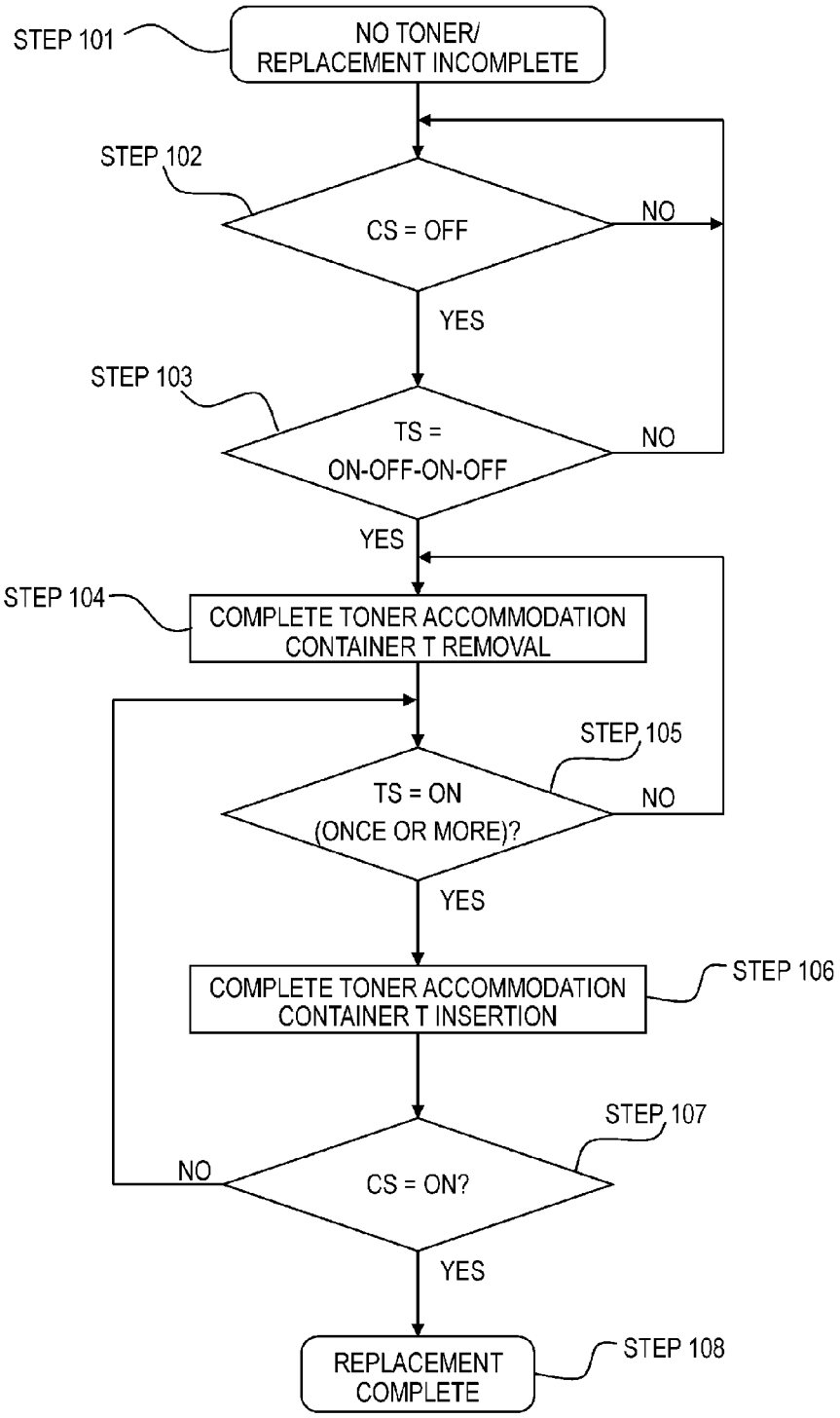
FIG. 15 is a flow chart illustrating the control flow of the toner supply operation.

Concerning the replacement detection configuration, the flow for the replacement of the toner accommodation container T will be described by using FIG. 15.

The supply control such that the value of the induction sensor IS is made equal to the threshold or more by a command from the CPU 50 described above is exercised, but if the value of the induction sensor IS is not equal to the threshold or more after a predetermined number of sheets or more being passed, the CPU 50 issues a display of no toner to the display portion 60 (STEP 101). The display portion 60 functions as an output portion to output information prompting for replacement of the toner accommodation container.

When the user confirms that there is no toner by viewing the display portion 60 and opens the front door 700, the CPU 50 obtains a signal of OFF from the front door sensor CS (STEP 102).

When the user removes the toner accommodation container T, the CPU 50 obtains signals of ON-OFF-ON-OFF from the phase detection sensor TS (STEP 103) and determines that the toner accommodation container T has been removed from the main body (STEP 104).

When the user inserts the new toner accommodation container T into the main body, the CPU 50 obtains an ON signal from the phase detection sensor TS once or more (STEP 105) and determines that the insertion of the toner accommodation container T is complete (STEP 106).

When the user closes the front door 700, the CPU 50 obtains an ON signal from the front door sensor CS (STEP 107) and determines that the replacement of the toner accommodation container T is complete (STEP 108).

When the above flow is complete, the CPU 50 deletes the display of no toner issued to the display portion 60.

From the above, by performing replacement detection and rotation detection of the toner accommodation container T by the same detection unit (phase detection sensor TS), a recording material can be output at an early stage at low cost without causing the user to perform a troublesome operation such as confirming the replacement of the toner accommodation container T.

Second Embodiment

Figure 16:
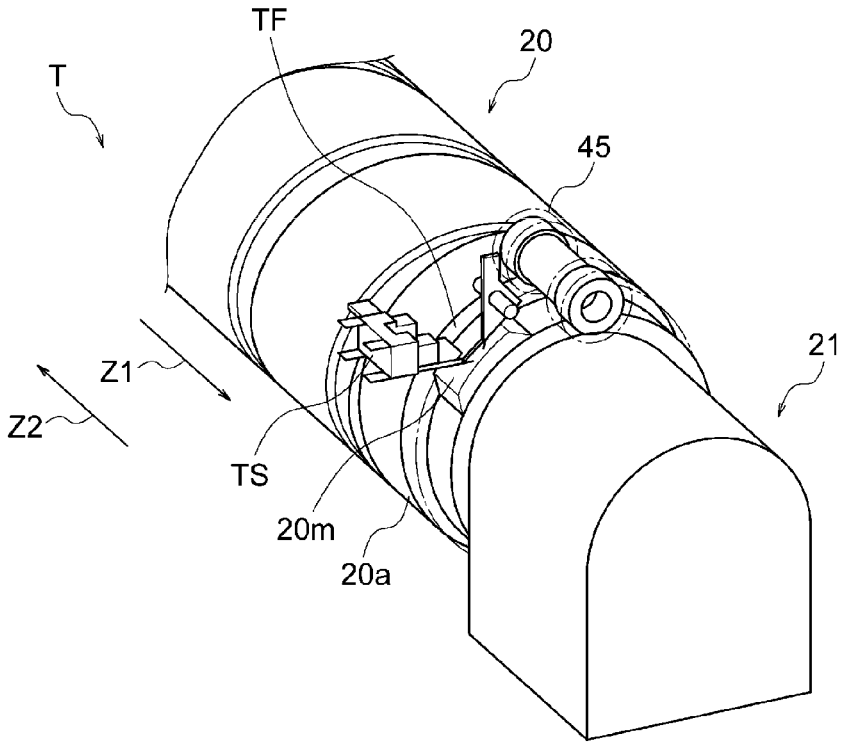
FIG. 16 is a perspective view of the toner accommodation container in a second embodiment.

The second embodiment of the present invention will be described. FIG. 16 illustrates a perspective view when the toner accommodation container T according to second embodiment of the present invention is installed in the apparatus body. In the aforementioned first embodiment, the mounting of the toner accommodation container T on the apparatus body is detected by the phase detection sensor TS being turned ON by the insertion/removal detection portion 21*m* provided in the flange portion 21 of the toner accommodation container T by inserting the toner accommodation container T into the apparatus body. In contrast to the first embodiment, the flange portion 21 of the toner accommodation container T according to the second embodiment is not provided with the insertion/removal detection portion 21*m*. In the second embodiment, a mechanism to lock the front door 700 when the toner accommodation container T is removed is provided and mounting of the toner accommodation container T on the apparatus body is detected by the front door sensor CS being turned ON caused by the closing of the front door 700. The description thereof will be provided below.

The image creating process is basically performed by, like in the first embodiment, the image forming apparatus illustrated in FIG. 1 and the internal configuration of the toner accommodation container T, the toner supply configuration, and the toner accommodation container rotation detection configuration are the same.

Therefore, the description of operation of the image forming apparatus is omitted and the description focuses on the replacement detection configuration of the toner accommodation container.

<Supply driving configuration>

Figure 18A:
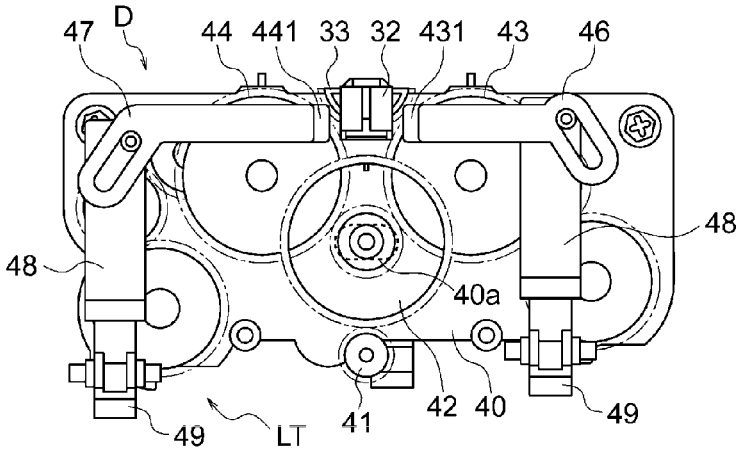
FIGS. 18A to 18C are operation diagrams of the supply driving apparatus in the second embodiment.

The supply driving configuration will be described by using FIGS. 17 and 18. FIGS. 17A to 17C are right side views of the main body of the image formation apparatus. FIG. 17A is a state in which the toner accommodation container T is installed inside the image forming apparatus and the front door 700 is closed, FIG. 17B is a state in which the front door 700 is opened from the state of FIG. 17A, and FIG. 17C is a state in which the toner accommodation container T is removed from the state of FIG. 17B. FIGS. 18A to 18C are diagrams of the supply driving apparatus D when viewed from the rear side of the main body and states of FIGS. 18A, 18B, and 18C correspond to the states of FIGS. 17A, 17B, and 17C respectively.

The state of FIG. 17B is reached by rotating the front door 700 in an arrow X1 direction in FIG. 17A (operation to open the front door 700). At this point, opening/closing levers 30*ab*, 30*cd* in accordance with opening/closing of the front door 700. The opening/closing levers 30*ab*, 30*cd* (each member has the common shape and thus, 30*ab* and 30*cd* are denoted as 30 below) biased by the front door 700 move in an arrow X2 direction accompanying opening/closing of the front door 700.

At this point, the front door sensor CS having detected the closed state (signal ON) of the front door 700 changes to a signal OFF after the front door 700 being opened.

In the supply driving apparatus D, the pinion gear 41 provided coaxially with the bottle driving motor 80 is installed by being engaged with the swing gear 42 (see FIG. 6). The swing gear 42 is movably supported by the long hole 40*a* in a circular arc shape provided in the gear frame 40 around the pinion gear 41. Accordingly, the swing gear 42 swings along the long hole 40*a* while rotating when the rotation of the bottle driving motor 80 is transmitted via the pinion gear 41.

The swing gear 42 is swung in the right direction along the long hole 40*a* by the bottle driving motor 80 in FIG. 18 being rotated clockwise to engage with the step gear 43 rotatably supported by the gear frame 40. Conversely, the swing gear 42 is swung in the left direction along the long hole 40*a* by the bottle driving motor 80 being rotated counterclockwise to engage with the step gear 44 rotatably supported by the gear frame 40. The drive is not transmitted to the step gear 44 side when the swing gear 42 is engaged with the step gear 43 and the drive is not transmitted to the step gear 43 side when the swing gear 42 is engaged with the step gear 44. Downstream of the step gears 43, 44, the drive is linked to the gear portion 20*a* on the toner accommodation container T while predetermined deceleration being performed. That is, the toner accommodation containers Ta, Tc can be operated by the bottle driving motor 80 in FIG. 18 being rotated counterclockwise and the toner accommodation containers Tb, Td can be operated by the bottle driving motor 80 being rotated clockwise.

Figure 18B:
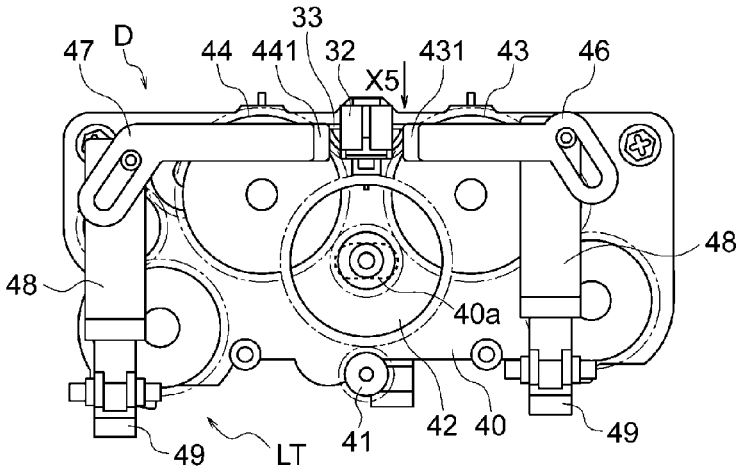
Figure 18C:
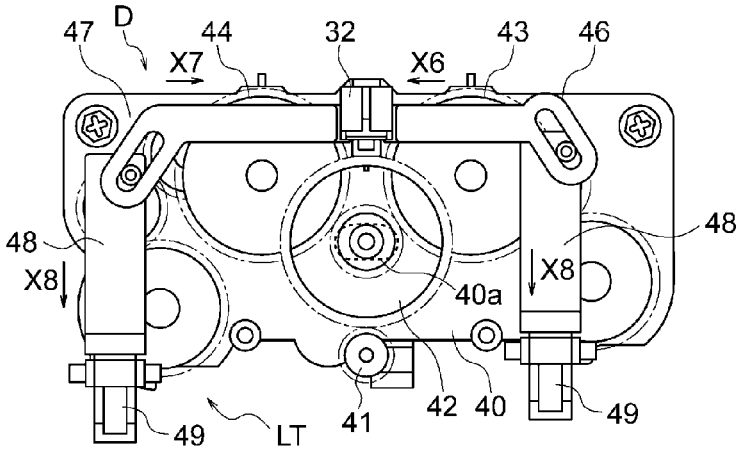

When the front door 700 reaches the open state illustrated in FIG. 17B (state in which the user can touch the toner accommodation container T), as illustrated in FIG. 18B, a lock member 33 engages with the step gears 43, 44. That is, the rotation of the toner accommodation container T is suppressed with an opening operation of the front door 700 and the suppression of rotation of the toner accommodation container T is released with a closing operation of the front door 700.

<Toner accommodation container replacement detection configuration>

Next, the toner accommodation container replacement detection configuration having a featuring configuration of the present embodiment will be described in detail by using FIGS. 16 to 21.

Figure 19A:
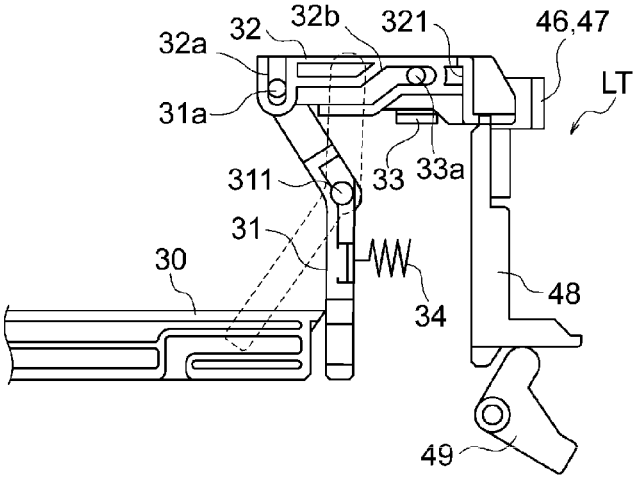
FIGS. 19A to 19C are operation diagrams of a door opening/closing lock mechanism in the second embodiment.
Figure 19B:
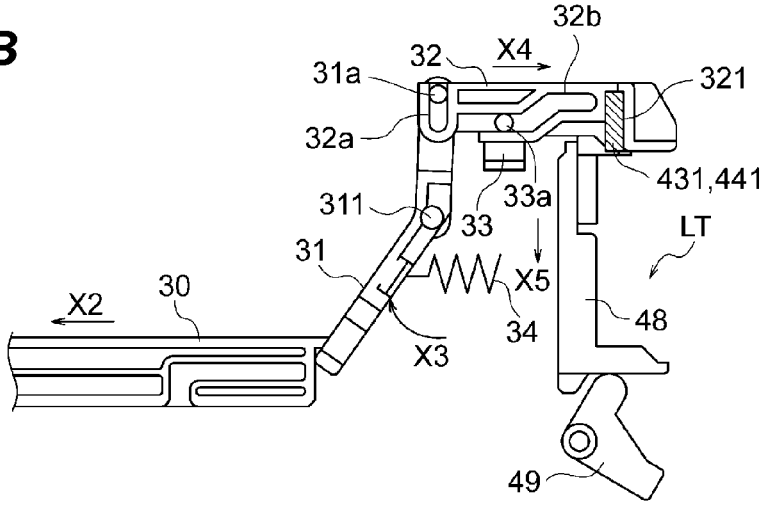
Figure 19C:
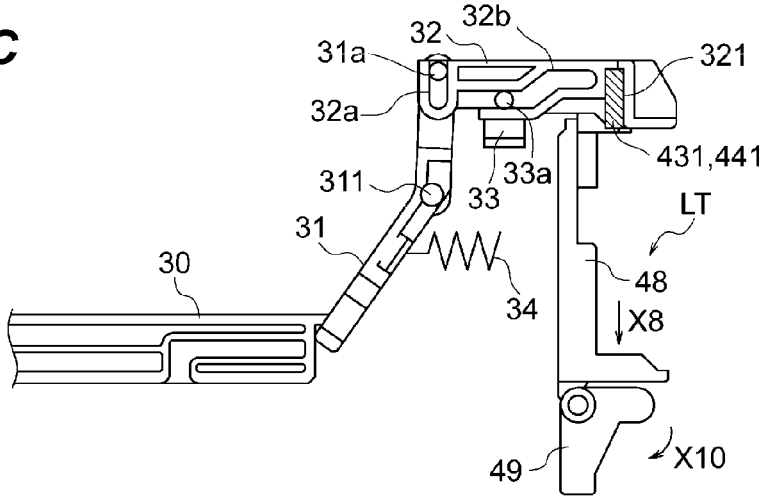

FIGS. 19A to 19C are diagrams when a door opening/closing lock mechanism LT is viewed from the right side of the main body and states of FIGS. 19A, 19B, and 19C correspond to states of FIGS. 17A, 17B, and 17C respectively.

The state illustrated in FIG. 19A is a state in which, as illustrated in FIG. 17A, the toner accommodation container is mounted on the apparatus body and the front door 700 is closed and in this state, the opening/closing lever 30 is regulated to be in a position illustrated in FIG. 19A by the front door 700. Thus, a link arm 31 biased toward the turning direction (arrow X3 direction) by a lock spring 34 is regulated to be in a solid line position by the opening/closing lever 30 against a biasing force of the lock spring 34.

If, as illustrated in FIG. 17B, the front door 700 is opened from this state, as illustrated in FIG. 19B, the regulation of the opening/closing lever 30 is released. Thus, the link arm 31 turns in the arrow X3 direction due to the biasing force of the lock spring 34 and the opening/closing lever 30 is moved in the arrow X2 direction accompanying the turning.

A projected portion 31*a* is provided at an end of the link arm 31 and is engaged with a guide groove 32*a* of a slider 32. With the turning of the link arm 31 in the arrow X3 direction as described above, the projected portion 31*a* of the link arm 31 presses the guide groove 32*a* of the slider 32 while being guided thereto and thus, the slider 32 moves in an arrow X4 direction. The link arm 31 is provided with a guide groove 32*b* that guides a projected portion 33*a* of a lock member 33 by being engaged therewith. With the movement of the slider 32 in the arrow X4 direction accompanying the turning of the link arm 31, the projected portion 33*a* engaged with the guide groove 32*b* is guided and the lock member 33 moves in an arrow X5 direction.

In this state, the toner accommodation container T can be removed from the apparatus body.

Figure 20A:
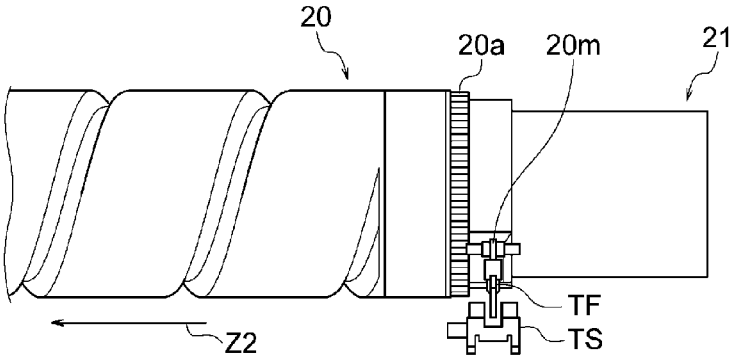
FIGS. 20A to 20D are insertion/removal transition diagrams of the toner accommodation container in the second embodiment.
Figure 20B:
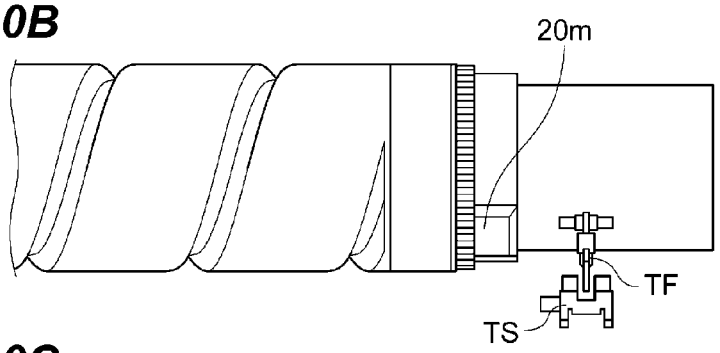
Figure 20C:
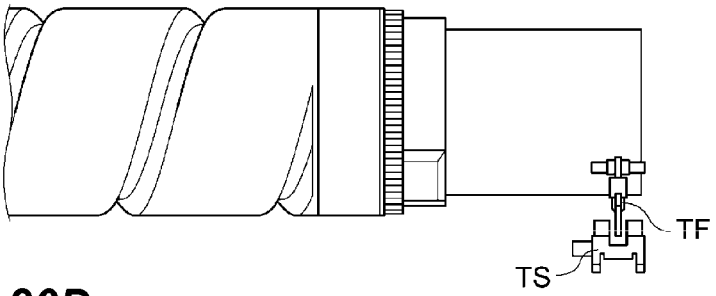
Figure 20D:
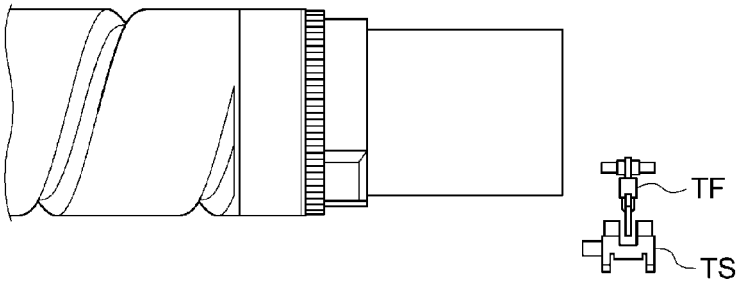
Figure 21:
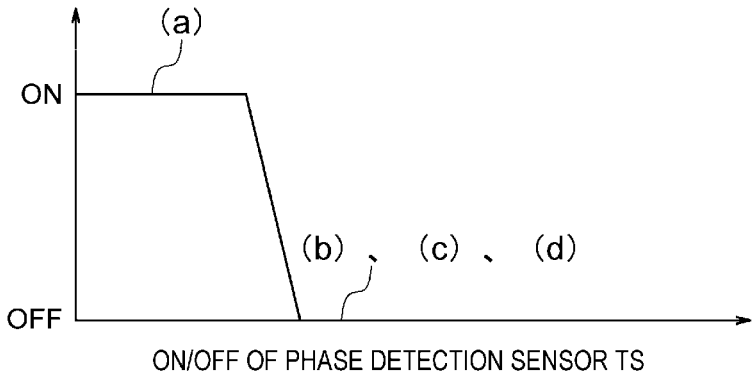
FIG. 21 is an insertion/removal detection transition diagram in the second embodiment.

FIGS. 20A to 20D are diagrams when the toner accommodation container T is viewed from above the main body and FIG. 21 is a rotation detection sensor signal transition diagram. States of FIGS. 20A to 20D and ON-OFF signals of the phase detection sensors TS of (a) to (d) illustrated in FIG. 21 correspond respectively. In addition, the state of FIG. 20A corresponds to that of FIG. 16.

In the initial state illustrated in FIG. 20A, the phase detection portion 20*m* is in contact with the detection flag TF and the detection flag TF blocks the optical axis of the phase detection sensor TS and therefore, the phase detection sensor TS is turned ON.

The toner accommodation container T is moved in in the arrow Z2 direction in FIG. 20A from the initial state illustrated in FIG. 20A. Accordingly, as illustrated in FIG. 20B, the phase detection portion 20*m* moves away from the detection flag TF to be displaced to a position in which the detection flag TF does not block the optical axis of the phase detection sensor TS and the phase detection sensor TS is thereby turned OFF.

If the toner accommodation container T is still moved in the arrow Z2 direction in FIG. 20A, the toner accommodation container T is removed from the apparatus body after states illustrated in FIGS. 20C and 20D (while the phase detection sensor TS is OFF) being reached.

If the front door 700 is in an open state (the front door sensor CS is OFF) and the phase detection sensor TS is turned ON-OFF, the removal of the toner accommodation container T from the apparatus body can be determined.

When the toner accommodation container T is removed from the apparatus body, the door opening/closing lock mechanism LT operates and a detailed operation thereof will be described by using FIGS. 17, 18, and 19.

The door opening/closing lock mechanism LT includes slide locks 46, 47, a bottle arm 48, and a bottle lever 49.

If the toner accommodation container T is removed from the apparatus body after, as illustrated in FIG. 17A, the front door 700 is opened, abutting of the toner accommodation container T and the bottle lever 49 (see FIG. 17B) is released. The bottle lever 49 abuts on the bottle arm 48 and the bottle arm 48 is biased in an arrow X8 direction by a biasing member such as a spring. Thus, when the abutting is released as described above, the bottle lever 49 turns in an arrow X10 direction in FIG. 19C by being pushed by the bottle arm 48. The bottle arm 48 has a boss 48*a* engaged with inclined long holes 46*a*, 47*a* held by the slide locks 46, 47 respectively. Thus, with the movement of the bottle arm 48 in the arrow X8 direction accompanying the turning of the bottle lever 49 described above, as illustrated in FIG. 18C, the slide locks 46, 47 are pushed by the boss 48*a* of the bottle arm 48 via the long holes 46*a*, 47*a* and move in arrows X6, X7 directions respectively. When the slide locks 46, 47 move, lock portions 431, 441 of the slide locks 46, 47 move from the position illustrated in FIG. 18B to the position illustrated in FIG. 18C to enter the projection plane in the direction of movement of the slider 32 before being engaged with a regulation surface 321 of the slider 32. Accordingly, the lock portions 431, 441 regulate movement of the slider 32 in the opposite direction of the arrow X4 direction in FIG. 19B. Thus, the movement of the rotatable link arm 31 linked to the slider 32 and that of the opening/closing lever 30 abutting on the link arm 31 are also regulated and as a result, the front door 700 cannot be closed.

That is, the door opening/closing lock mechanism LT locks the opening/closing lever 30 (30*ab*, 30*cd* in FIG. 4) moved by accompanying an opening operation of the front door 700 in a regulation position (position illustrated in FIG. 15) regulating a closing operation of the front door 700 by a removal operation of the toner accommodation container T. Accordingly, if the toner accommodation container T is not inserted after the aforementioned removal operation, the closing operation of the front door 700 is suppressed by the opening/closing levers 30*ab*, 30*cd* locked by the door opening/closing lock mechanism LT. Consequently, the CPU 50 detects that the front door 700 is not closed based on a signal from the front door sensor CS and the toner accommodation container T is not mounted on the main body of the image forming apparatus.

That is, the CPU 50 grasps the removal of the toner accommodation container T from the phase detection sensor TS. On the other hand, the CPU 50 indirectly detects installing (mounting) of the toner accommodation container T on the apparatus body by the front door sensor CS being turned ON caused by the closing of the front door 700.

Namely, the regulation of movement of the slider 32 by the lock portions 431, 441 is released and the lock of the opening/closing levers 30*ab*, 30*cd* locked by the door opening/closing lock mechanism LT is released by an insertion operation of the toner accommodation container T following a reversed procedure of the aforementioned procedure for removal. Thus, the suppression of the closing operation of the front door 700 by the opening/closing levers 30*ab*, 30*cd* is released and the closing operation of the front door 700 is also enabled by the toner accommodation container T being mounted on the image forming apparatus. Accordingly, the replacement of the toner accommodation container can be grasped by the front door sensor CS being turned ON after the aforementioned removal operation of the toner accommodation container T.

The operation of the slide locks 46, 47 has been described simultaneously above, but the movement of the slider 32 can also be regulated only by one of the slide locks 46, 47.

<Replacement detection flow>

Figure 22:
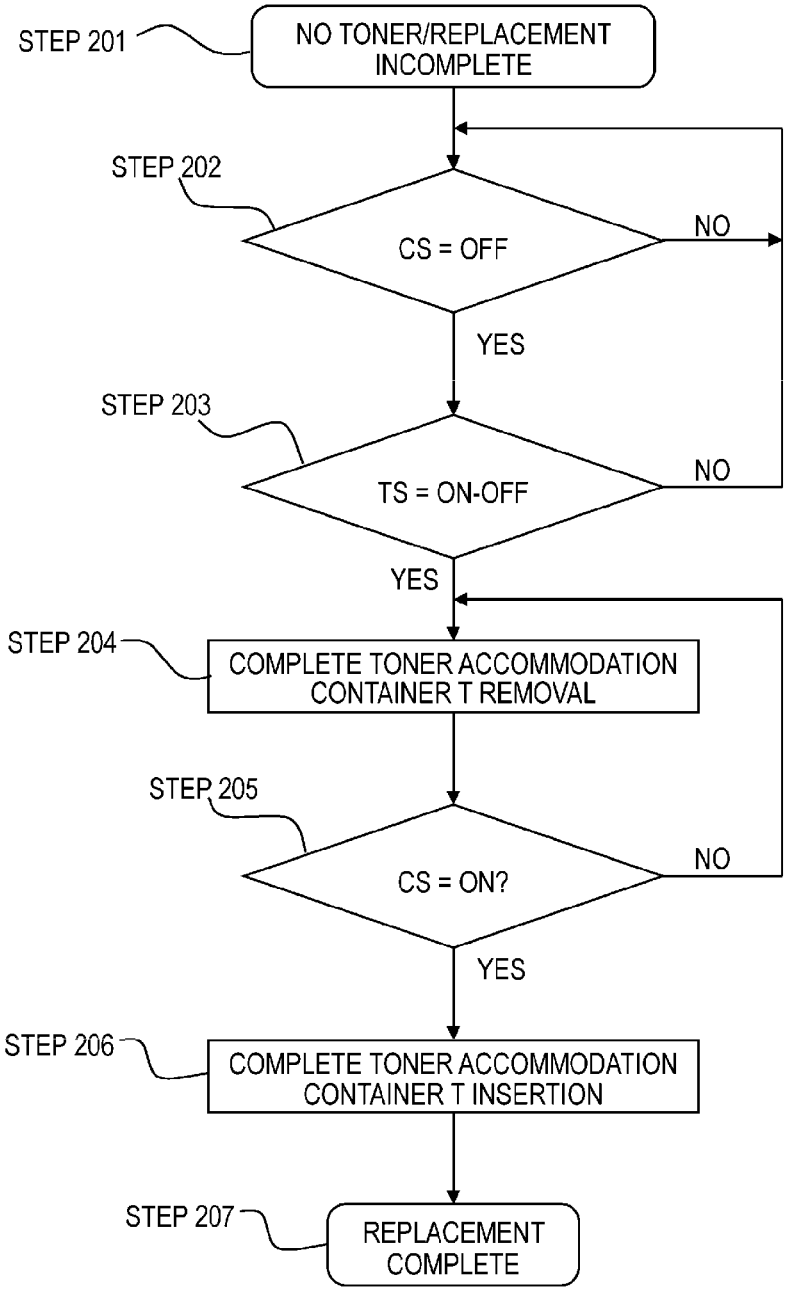
FIG. 22 is a flow chart illustrating the control flow of the toner supply operation.

Concerning the replacement detection configuration, the flow for the replacement of the toner accommodation container T will be described by using FIG. 22.

The supply control such that the value of the induction sensor IS is made equal to the threshold or more by a command from the CPU 50 described above is exercised, but if the value of the induction sensor IS is not equal to the threshold or more after a predetermined number of sheets or more being passed, the CPU 50 issues a display of no toner to the display portion 60 (STEP 201).

When the user confirms that there is no toner by viewing the display portion 60 and opens the front door 700, the CPU 50 obtains a signal of OFF from the front door sensor CS (STEP 202).

When the user removes the toner accommodation container T, the CPU 50 obtains signals of ON-OFF from the phase detection sensor TS (STEP 203) and determines that the toner accommodation container T has been removed from the main body (STEP 204).

When the user inserts the new toner accommodation container T into the main body, the aforementioned door opening/closing lock mechanism LT is released and the front door 700 can physically be closed.

When the user closes the front door 700, the CPU 50 obtains a signal of ON from the front door sensor CS (STEP 205) and determines that the insertion of the toner accommodation container T is complete (STEP 206) and the replacement is complete (STEP 207).

When the above flow is complete, the CPU 50 causes a predetermined operation concerning the replacement operation of the toner accommodation container T. In the present embodiment, the display of no toner issued to the display portion 60 is deleted as a predetermined operation concerning the replacement operation of the toner accommodation container T. That is, in the present embodiment, whether to delete the display of no toner is decided based on both of a signal of the phase detection sensor and a signal of the front door sensor CS. However, whether to delete the display of no toner may be decided based on a signal of the phase detection sensor.

From the above, by performing replacement detection and rotation detection of the toner accommodation container T by the same detection unit (phase detection sensor TS), a recording material can be output at an early stage at low cost without causing the user to perform a troublesome operation such as confirming the replacement of the toner accommodation container T.

In the present embodiment, an operation to delete the display of no toner issued to the display portion 60 is performed based on a signal of the phase detection sensor, but the present embodiment is not limited to such an example.

For example, if configured to disable an image forming operation with the display of no toner, the predetermined operation concerning the replacement operation of the toner accommodation container T may be an operation to end disabling of the image forming operation. Alternatively, the predetermined operation concerning the replacement operation of the toner accommodation container T may be a predetermined operation to check whether the replacement operation of the toner accommodation container T has been performed correctly. That is, an operation to check whether the output (density) of the induction sensor IS is restored after toner is supplied may be performed by performing an idle rotation operation of the toner accommodation container after replacement.

It is needless to say that the configuration of the present embodiment described above can be carried out similarly in the first embodiment.

In the aforementioned second embodiment, a configuration in which a single sensor to detect opening/closing of the front door is used to indirectly detect mounting of the toner accommodation container is illustrated, but by adopting a configuration in which, for example, a dedicated replacement door is provided for each color and opening/closing thereof is detected by the respective sensor, the replacement of the toner accommodation container for each color can be detected. However, the present invention is not configured in such a manner and cannot detect the color of a removed toner accommodation container only from opening/closing detection of the front door.

According to the present embodiment, the replacement of a toner accommodation container and the phase of the toner accommodation container can be detected by using an inexpensive configuration. As a result, a recording material can be output at an early stage after the toner accommodation container being replaced without causing a user to perform a troublesome replacement checking operation.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-140344, filed Jul. 4, 2013, which is hereby incorporated by reference herein in its entirety.

What is claimed is:

1. An image forming apparatus, comprising:

a toner container provided detachably mountable in image forming apparatus and configure to discharge a toner by rotating, the toner container including a flange portion being regulated in rotation when the toner container is inserted into the image forming apparatus and a rotation portion provided rotatably with respect to the flange portion, the rotation portion including an internal space to accommodate the toner;

a phase detection sensor configured to detect whether or not the toner container is positioned at a predetermined phase;

a detected portion provided on the rotation portion configured to change the output of the phase detection sensor when the toner container is positioned at the predetermined phase;

a door member that opens and closes an opening portion through which the toner container is inserted and removed;

an opening and closing detection sensor that detects whether the door member is positioned in a close position in which the door member closes the opening portion or in an open position in which the door member opens the opening portion;

a display portion configured to display an information prompting for replacement of the toner container; and a controller configured to control the rotation of the toner container based on the signal from the phase detection sensor in order to stop the toner container in the predetermined phase, the controller controlling a display of the information based on a output of the phase detection sensor and the opening and closing detection sensor, wherein the toner container includes an insertion and removal detected portion provided on the flange portion so as to change the output of the phase detection sensor along with the insertion of the toner container into the image forming apparatus or the removal of the toner container from the image forming apparatus.

* * * * *